US007287462B2

(12) United States Patent
Dengler et al.

(10) Patent No.: US 7,287,462 B2
(45) Date of Patent: Oct. 30, 2007

(54) HIGH-LEVEL BUILT-IN OVEN UNIT

(75) Inventors: Klaus Dengler, Schönau (DE); Felix Hangl, Freilassing (DE); Wolfgang Schnell, Trostberg (DE); Josef Gerl, Palling (DE); Christian Zimmerman, Garching/Alz (DE); Klemens Roch, Trostberg (DE); Klaus Rabenstein, Trostberg (DE); Michael Wagner, Grabenstätt (DE); Reinhard Fleissner, Altenmarkt (DE); Christian Unterreiner, Ainring (DE); Johann Herbst, Traunreut (DE); Bernd Hopfenmüller, Traunreut (DE); Peter Mallinger, Traunreut (DE); Ingo Bally, Tittmoning (DE); Edmund Kuttalek, Grassau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 587 days.

(21) Appl. No.: 10/449,560

(22) Filed: May 29, 2003

(65) Prior Publication Data

US 2004/0074890 A1 Apr. 22, 2004

Related U.S. Application Data

(63) Continuation of application No. PCT/EP01/13380, filed on Nov. 19, 2001.

(30) Foreign Application Priority Data

Dec. 1, 2000 (DE) ..... 100 59 658

(51) Int. Cl.
*A23L 1/00* (2006.01)

(52) U.S. Cl. ..... 99/339; 99/448

(58) Field of Classification Search ..... 99/326–331, 99/339, 340, 352–355, 357, 448, 467–476, 99/483; 219/398, 411, 391, 386, 405, 702, 219/720; 126/273 A, 19 M, 19 R, 21 A, 126/20, 275 R, 275 E See application file for complete search history.

(56) References Cited

U.S. PATENT DOCUMENTS

| | | | | |
|---|---|---|---|---|
| 1,351,415 | A | 8/1920 | Coumerilh | |
| 2,003,059 | A | 5/1935 | Teller | |
| 2,889,442 | A | 6/1959 | Schultz | |
| 2,944,540 | A | 7/1960 | Littell, Jr. | |
| 4,219,716 | A * | 8/1980 | Kaufman et al. | 219/756 |
| 4,303,819 | A * | 12/1981 | Kaufman et al. | 99/357 |
| 4,628,185 | A * | 12/1986 | Norwood et al. | 219/386 |
| 4,791,861 | A * | 12/1988 | Weinkle et al. | 99/357 |
| 4,796,599 | A | 1/1989 | Cooper | |
| 4,814,571 | A * | 3/1989 | Bowen et al. | 219/757 |
| 4,884,626 | A * | 12/1989 | Filipowski | 165/231 |
| 5,228,763 | A * | 7/1993 | Gingold | 312/266 |
| 6,073,624 | A | 6/2000 | Laurent | |
| 6,382,086 | B1 * | 5/2002 | Roberts | 99/331 |
| 6,444,954 | B1 * | 9/2002 | Blankenship | 219/391 |
| 6,539,840 | B2 * | 4/2003 | Choi et al. | 99/331 |

* cited by examiner

*Primary Examiner*—Timothy F. Simone
(74) *Attorney, Agent, or Firm*—Russell W. Warnock; Craig J. Loest; James E. Howard

(57) ABSTRACT

A high-level built-in oven unit having a housing with a heated cooking chamber having a floor opening therein. The chamber has a lowerable trap-door movable between a position closing the floor opening and a lowered position opening the floor opening. The trap-door is movable by a lifting device, which has lifting elements mounted outside of the cooking chamber.

18 Claims, 7 Drawing Sheets

HIGH-LEVEL BUILT-IN OVEN UNIT

BACKGROUND OF THE INVENTION

Field of the Invention

The present invention relates to a high-level built-in oven unit and, in particular, to a high-level built-in oven with a lowerable trap-door and a baking tray mounting arrangement.

The wall-mounted oven known from the WO 98/04871 publication should be considered as a generic high-level built-in oven unit. The wall-mounted oven includes a cooking space or an oven chamber which is surrounded by sidewalls, a front, back and upper wall and which has an opening in its floor, whereby the back of the wall-mounted oven is to be mounted on a wall in the manner of a kitchen wall unit. The opening in the floor of the oven chamber can be closed by a lowerable trap-door. A support arrangement or a fixing piece for baking trays and other oven accessories is mounted on the upper surface of the trap-door.

In order to adjust the trap-door the wall-mounted oven has a lifting device with lifting elements which are connected with the trap-door. The lifting elements are shaped as linkage levers which are pivotably mounted, on the one hand, inside the oven chamber on its sidewalls and, on the other hand, on the fixing piece for baking trays, which is mounted on top of the trap-door. When the trap-door is adjusted the linkage levers may be pivoted parallel to a level of the sidewalls of the oven chamber.

One of the ends of the linkage levers mounted on the sidewalls of the oven chamber is non-rotatably connected with an actuating shaft. This actuating shaft protrudes from a sidewall of the oven chamber and may be driven by a drive motor located outside the oven chamber. Thus, when the drive motor is activated the linkage levers may be pivotally adjusted.

Due to their location inside the oven chamber the lifting elements are exposed during operation not only to contamination but also to high thermal loads which may adversely affect the operability of the lifting elements. Therefore the lifting elements require to be constructed in a very expensive manner in order to be able to withstand these loads.

The present invention includes a high-level built-in oven unit which has a lifting device which is more reliable in operation.

BRIEF SUMMARY OF THE INVENTION

The lifting device including its lifting elements is arranged outside the cooking space when the cooking space is closed. This means that according to the invention, the lifting elements of the lifting device are exposed neither to a thermal load during a cooking operation of the high-level built-in oven unit nor are they contaminated by the cooking of the food, thereby improving the operational reliability of the lifting device in a simple manner. Thus, according to the invention, only the baking tray mounting arrangement is provided inside the closed cooking space.

In order to keep the thermal load upon the lifting elements during the cooking operation to a minimum, a sealed zone is provided between the closed trap-door and the floor of the heated chamber and the lifting elements are connected with the trap-door outside this sealed zone.

According to a further development of the invention the upper surface of the trap-door facing the cooking space lies opposite the face of the floor frame of the heated chamber, when the cooking space is closed. This means that the trap-door can be actively pushed, for example, against the floor frame by means of a drive motor, so that the closed cooking space can be even more effectively thermally sealed relative to the lifting elements.

This thermal sealing between the closed cooking space and the lifting elements is reinforced by the fact that an O-ring shaped seal is arranged between the upper surface of the closed trap-door and the floor frame of the heated chamber. In this context it is advantageous if the upper surface of the trap-door is covered by a heat-resistant plate with a small thermal expansion coefficient. A thermally-caused distortion or deformation of the plate is thus avoided so that for a cooking operation with closed trap-door it is ensured that the heat-resistant plate sealingly rests against the floor frame of the heated chamber. In order to ensure a simple construction of the heat-resistant plate it is favourable if the lifting elements are connected with the trap-door outside the heat-resistant plate.

A stable and constructionally simple design of the lifting elements is achieved if these are shaped as rigid L-shaped supports, each of which includes a vertical arm cooperating with the lifting device and a horizontal arm supporting the trap-door. In order to ensure unrestricted access to the upper surface of the lowered trap-door, the horizontal arms of the L-shaped supports engage in support portions of the trap-door in the rearward area of the high-level built-in oven unit.

In order to be able to adjust the trap-door in a simple manner the lifting device is provided with a drive motor which is connected with the L-shaped supports.

BRIEF DESCRIPTION OF THE DRAWING

An embodiment of the invention will now be described with reference to the attached drawings of which.

DETAILED DESCRIPTION OF THE INVENTION

Figure 1:
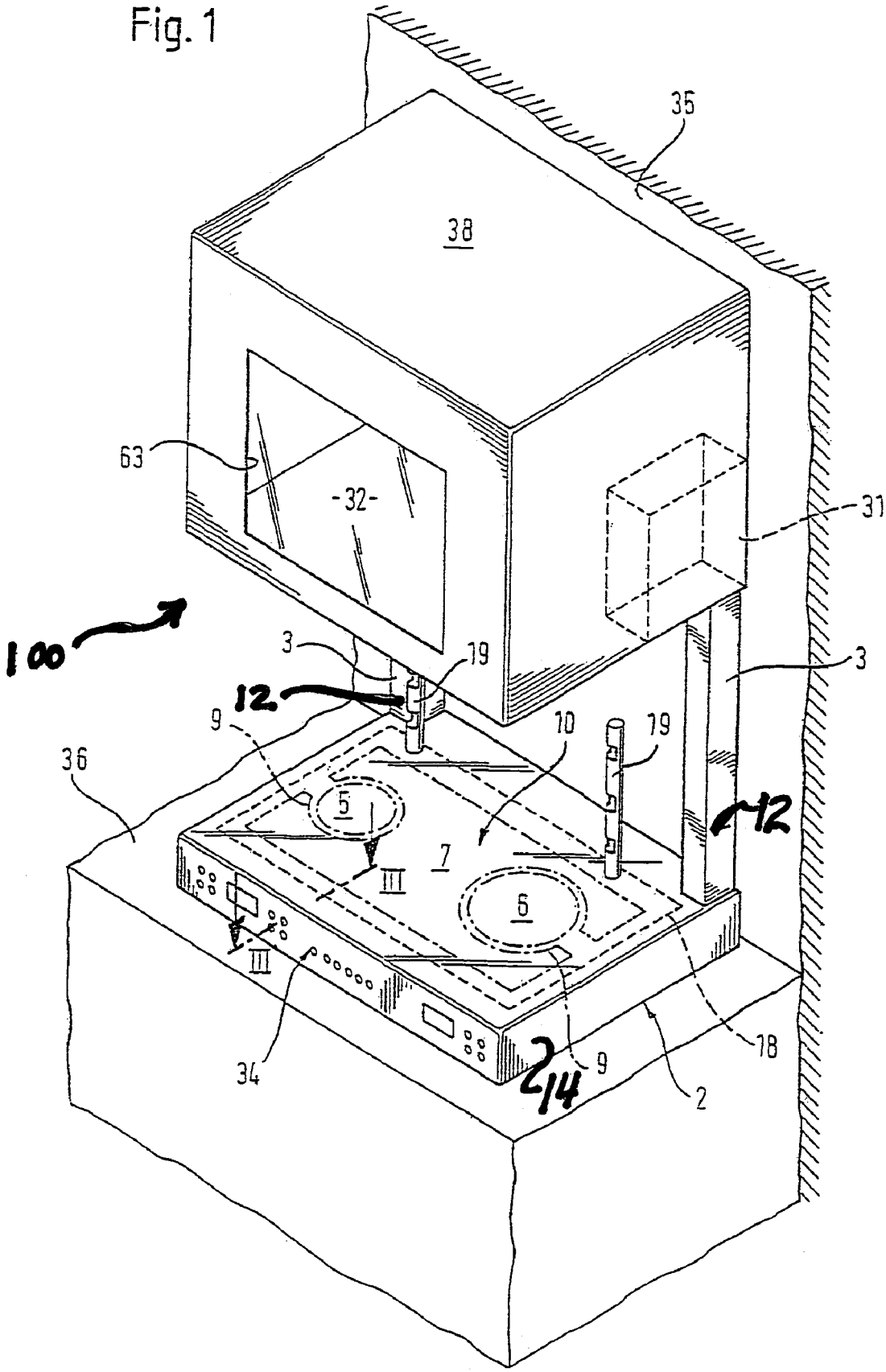
FIG. 1 shows a perspective view of a wall-mounted high-level built-in oven unit with lowered trap-door.
Figure 4:
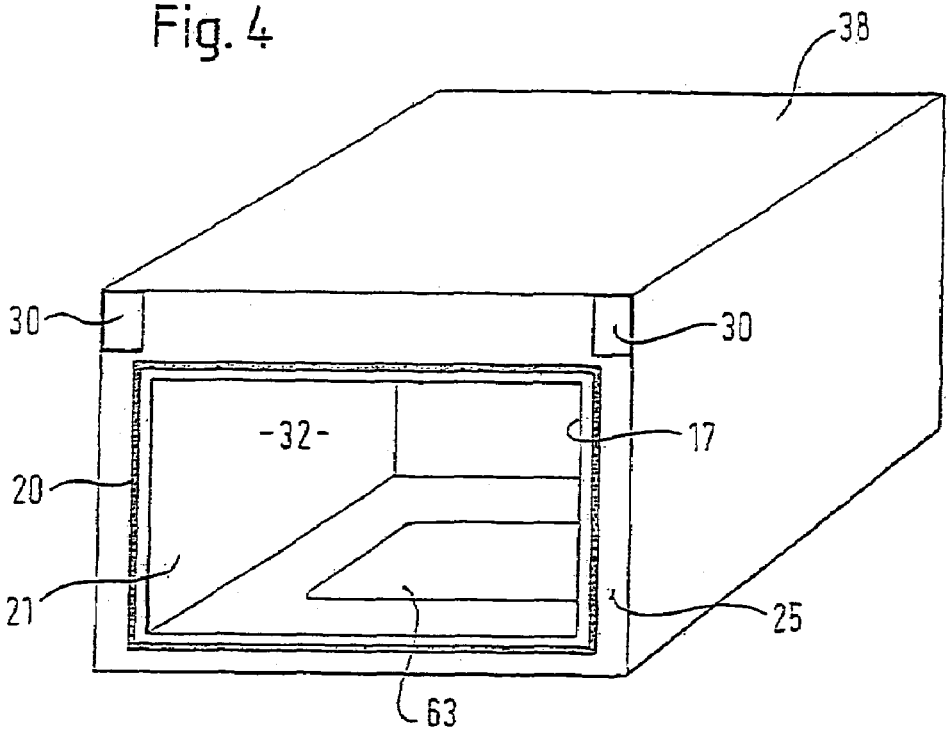
FIG. 4 shows a perspective view of a housing of the wall-mounted high-level built-in oven unit without trap-door.

FIG. 1 shows a high-level built-in oven unit 100 with a housing 38. The rear of the housing 38 is mounted onto a wall 35 in the manner of a wall-mounted kitchen unit. In the housing 38 a cooking space 32 is defined which may be inspected via a window 63 inserted into the front of the housing 38. FIG. 4 shows that the cooking space 32 is defined by a heated chamber 21 provided with a heat-insulating casing not shown, and that the heated chamber 21 has floor opening 17. The floor opening 17 can be closed, for example, by a trap-door 2 shown in FIGS. 1 and 2. In FIG. 1 the trap-door 2 is shown in the lowered position, whereby its bottom surface is in contact with a work surface 36 of a kitchen unit.

Figure 2:
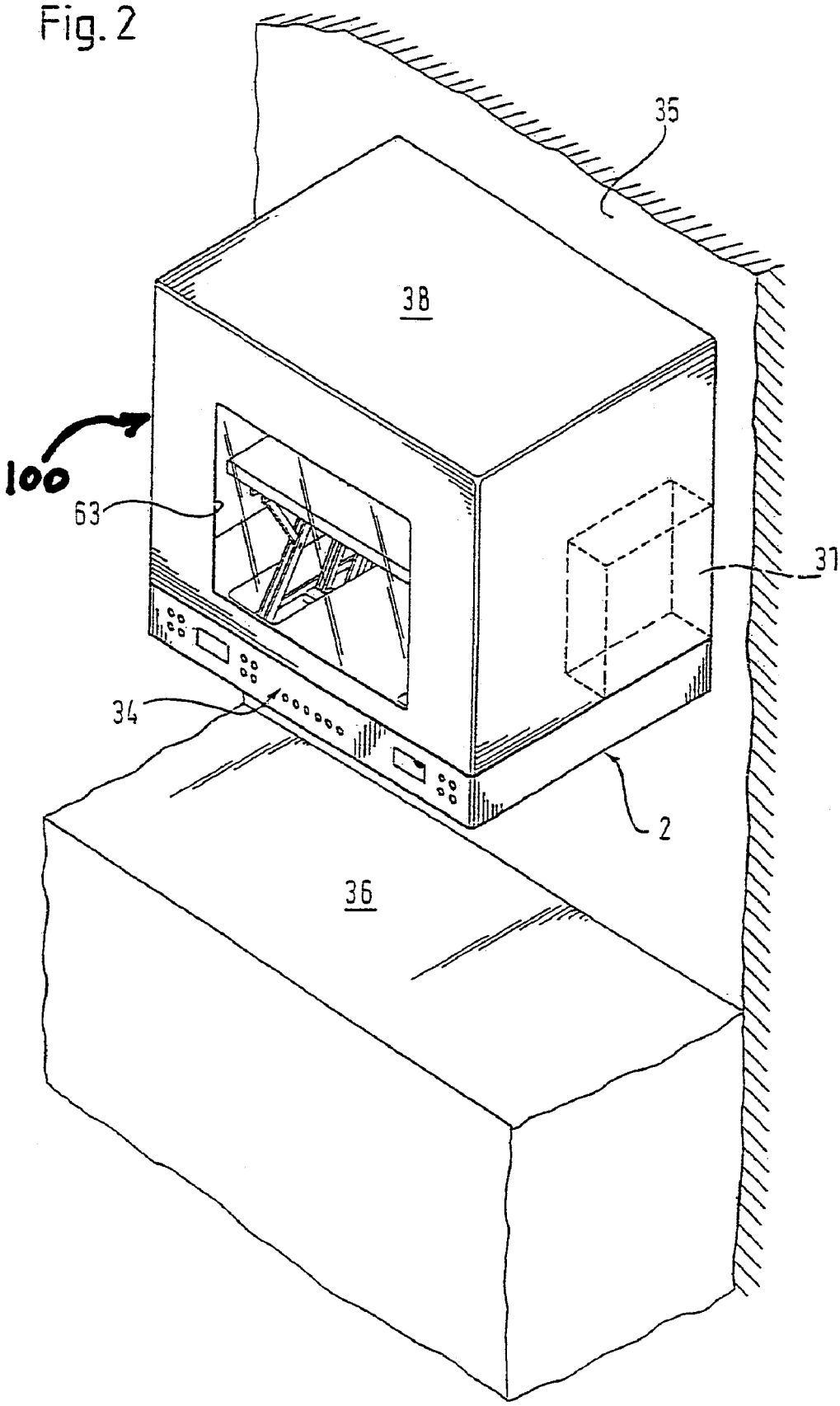
FIG. 2 shows a perspective view of a wall-mounted high-level built-in oven unit with closed trap-door.
Figure 5:
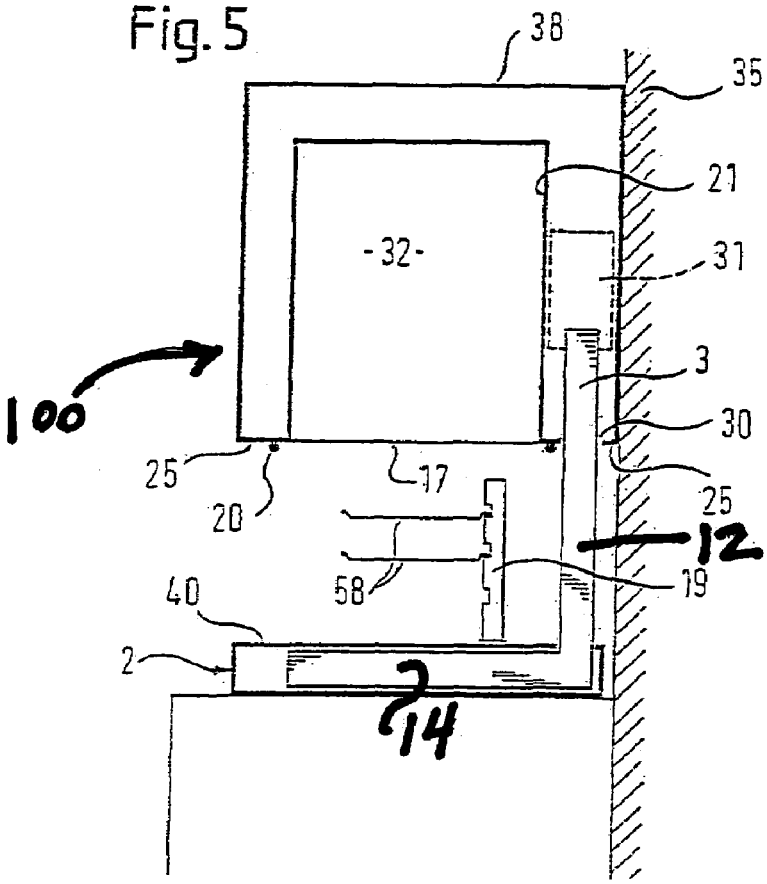
FIG. 5 shows a schematic side view of the wall-mounted high-level built-in over unit with lowered trap-door.
Figure 6:
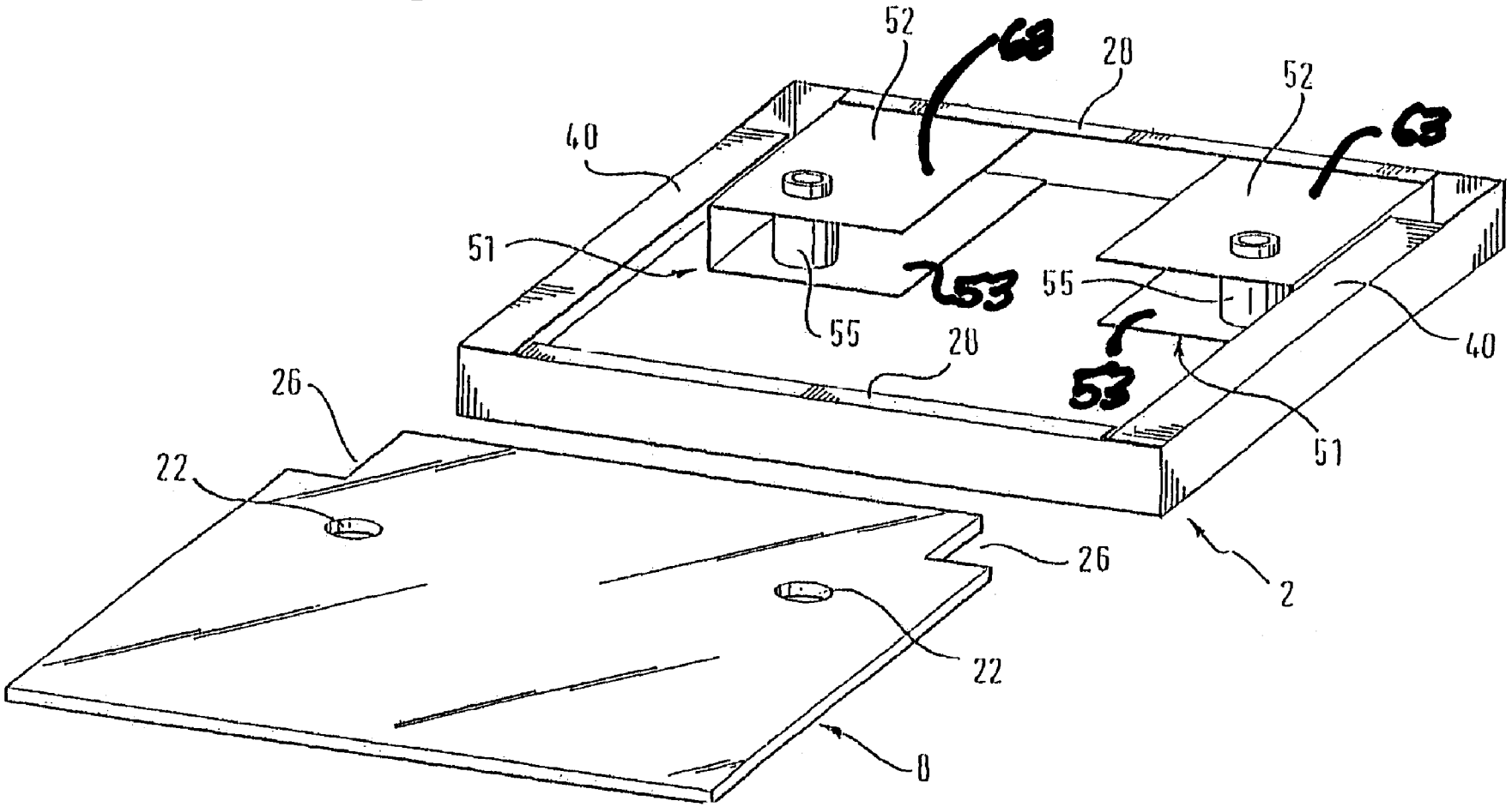
FIG. 6 shows a perspective view of the trap-door without lifting elements, whereby the glass-ceramic plate has been removed from the trap-door.

In order to close the cooking space 32 the trap-door 2 must be moved into the position shown in FIG. 2. In order to move the trap-door 2 the high-level built-in oven unit 100 includes a lifting device 3, 31. The lifting device 3, 31 includes a drive motor 31 shown as a broken line in FIGS. 1, 2 and 5, which is arranged between the heated chamber 21 and the outside wall of the housing 38. The drive motor 31 is arranged in the area of the rear of the housing 38 and is, as shown in FIG. 1 or 5, effectively connected with one of a pair of lifting elements 3 connected with the trap-door 2. According to the schematic side view in FIG. 5 each lifting element 3 is shaped as an L-shaped support. The vertical arm 12 of the L-shaped support 3 extends starting from the drive motor 31 on the housing 38, through frame openings 30 of a floor frame 25 and may be inserted into or retracted from the housing 38 in a vertical direction. The horizontal arm 14 of the L-shaped support 3 engages into a support portion 40 of the trap-door 2 in order to support the trap-door 2. A support portion 40 of this kind is formed on each narrow side of the trap-door 2 as shown in FIG. 6. FIG. 6 shows a perspective view of a profiled sheet 52 of the trap-door 2 as well as of a glass-ceramic plate 8 to be mounted on the profiled sheet 52. The support portions 40 were formed by bending upper portions of the sidewalls of the profiled sheet 52 of the trap-door 2 at 90° towards each other so that the horizontal arms 14 of the L-shaped supports 3 can grip underneath the support portions 40.

To adjust the trap-door 2 the drive motor 31 of the lifting device can be operated by means of a control on a control panel of a control unit 34, which is arranged on the front of the trap-door 2 as shown in FIGS. 1 and 2.

As can be seen from FIG. 1 the upper surface of the trap-door 2 includes a hob or cooktop 10. Most of the entire area of the hob 10 is occupied by heating elements 5, 6, 7, which are indicated by chain-dotted lines in FIG. 1. In FIG. 1 the heating elements 5, 6 are two hotplate heating elements of different size arranged at a distance from each other, whereas the heating elements 7 provided between the two hotplate heating elements 5, 6, is a sheet-type heating elements the side portions 9 of which almost enclose the hotplate heating elements 5, 6. The heating elements 5, 6, 7 are each associated with switching elements which can be controlled from the control unit 34, as will be described later.

In the embodiment shown the heating elements 5, 6, 7 are radiant heating elements which are covered by the glass-ceramic plate 8. The glass-ceramic plate 8 shown dissembled from the trap-door 2 in FIG. 6 has approximately the dimensions of the upper surface of the trap-door 2. At its rear comers the glass-ceramic plate 8 has two recesses 26 on its outer circumference rim which can partially enclose the openings of the holders 40. Consequently the L-shaped supports 3 are connected with the trap-door 2 outside the glass-ceramic plate 8. In addition the glass-ceramic plate 8 also has mounting holes 22 through which bases 50 described later protrude for mounting a fixing piece 19 of a baking tray arrangement 19, 51.

Figure 3:
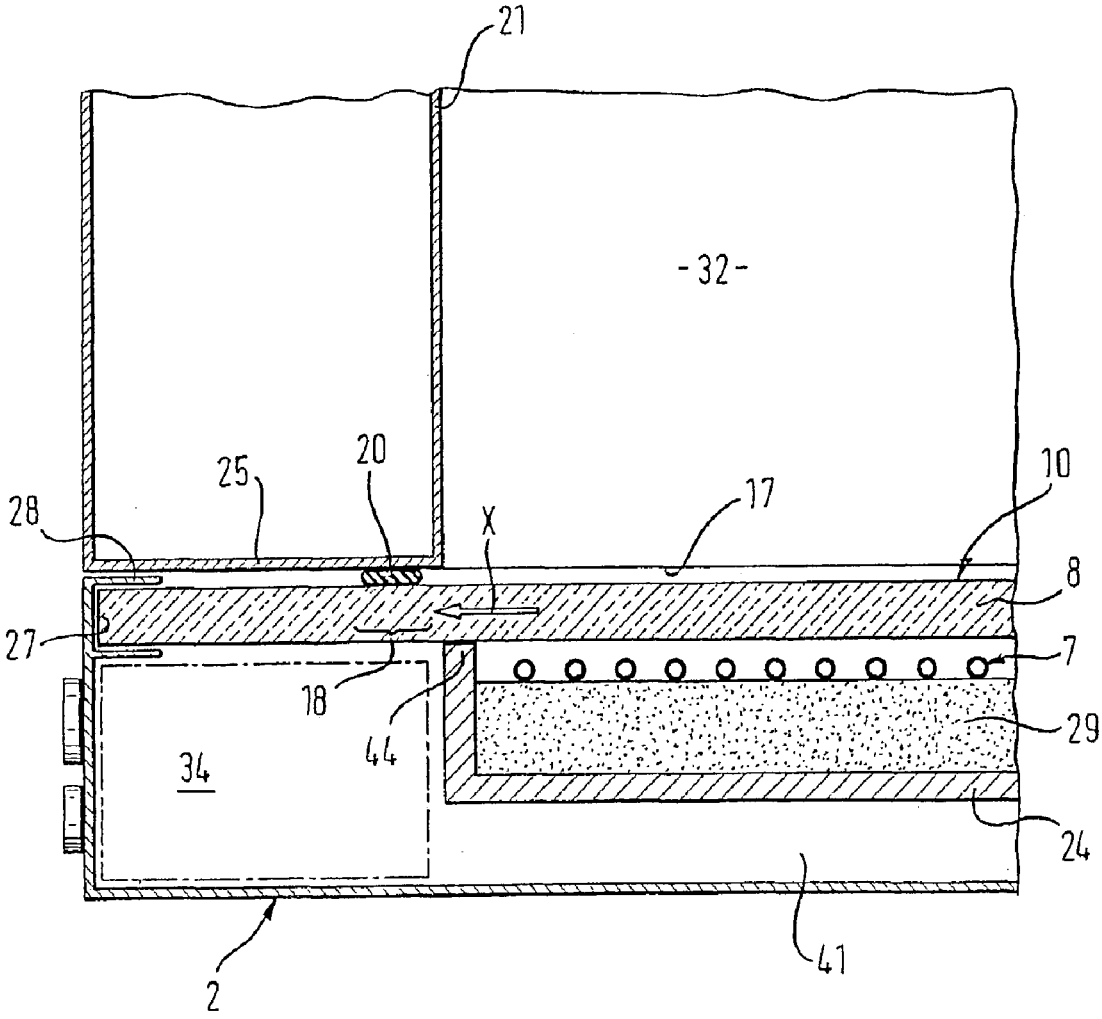
FIG. 3 shows an enlarged sectional view of the trap-door resting against the frame of the heated chamber along line III-III in FIG. 1.

According to the enlarged sectional view shown in FIG. 3 the upper surface of the trap-door 2 lies opposite the face of the floor frame 25. The glass-ceramic plate 8 of the trap-door 2 is surrounded on its circumference by a profiled frame 28 of a profiled sheet of the trap-door 2. A space 41 is formed between the glass-ceramic plate 8 and the bottom surface of the profiled sheet of the trap-door 2, in which the radiant heating elements 5, 6, 7 are arranged. For heat insulation the heating elements 5, 6, 7 are all received in a heating element housing 24, the circumferential rim 44 of which is connected with an underside of the glass-ceramic plate 8. Inside the heating element housing 24 the radiant heating elements 5, 6, 7 are positioned on an insulating body 29. In addition the space 41 houses functional components indicated by chain-dotted lines such as electronic components of the control unit 34. These functional components are arranged in a boundary area of the trap-door 2.

As shown in FIG. 3 the hob 10 occupied by the heating elements 5, 6, 7 directly extends as far as the area of the inside wall of the heated chamber 21. In this way a far-reaching area forming the hob 10 is achieved on the upper surface of the trap-door 2. Due to the low thermal conductivity of the glass-ceramic plate 8 the temperature of the glass-ceramic plate 8 outside the hob 10 quickly drops in the direction marked with x when the hob 10 is in operation. Thus an excessively large heat dissipation in the glass-ceramic plate 8 in x-direction is avoided due to the low thermal conductivity of the glass-ceramic plate 8.

FIG. 3 also shows that a seal 20 is arranged between the glass-ceramic plate 8 and the floor frame 25. The seal 20 is fitted into the floor frame 25 in a manner not shown and extends frame-like around the floor opening 17. When the trap-door 2 is closed a sealed zone 18 is thus created between the floor frame 25, the seal 20 and the glass-ceramic plate 8. The hob 10 is arranged inside the sealed zone 18, whereas the already mentioned boundary area of the glass-ceramic plate 8 lies outside the sealed zone 18. The boundary area of the glass-ceramic plate 8 situated outside the sealed zone 18 in the x-direction is therefore thermally very effectively uncoupled relative to the cooking space 32. This thermally uncoupled boundary area of the glass-ceramic plate 8 warms up only slightly when the high-level built-in oven unit is operated with the trap-door 2 closed, so that it is possible to avoid the burning-on of food on the glass-ceramic plate 8 outside the sealed zone 18 and to protect users from high temperatures of the trap-door 2. The boundary area of the glass-ceramic plate 8 which is critical as regards cleaning can thus be easily cleaned after a cooking operation.

Figure 7:
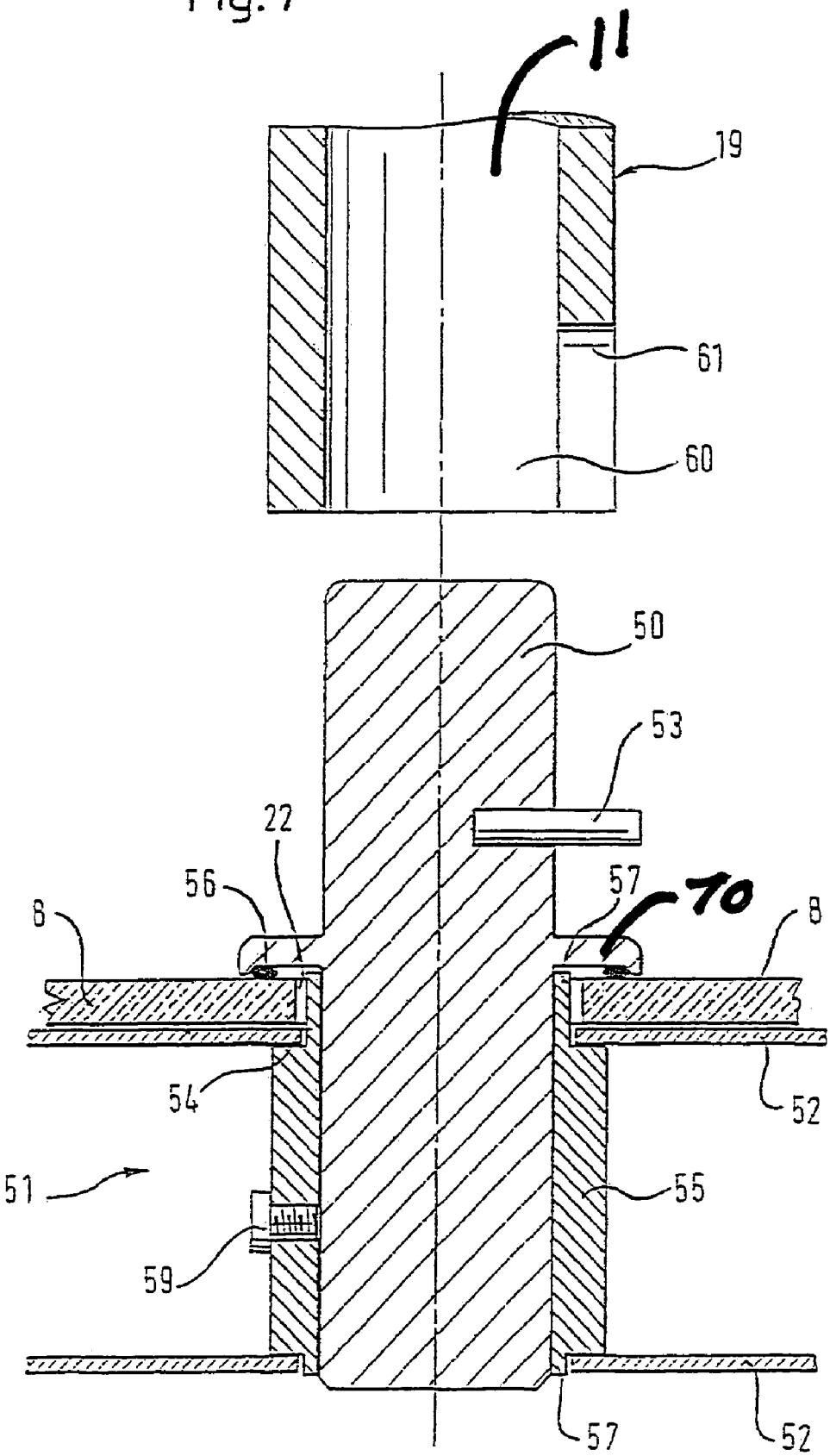
FIG. 7 shows a sectional view of an anchoring of the baking tray mounting arrangements attached to the trap-door with one support column removed from it.
Figure 8:
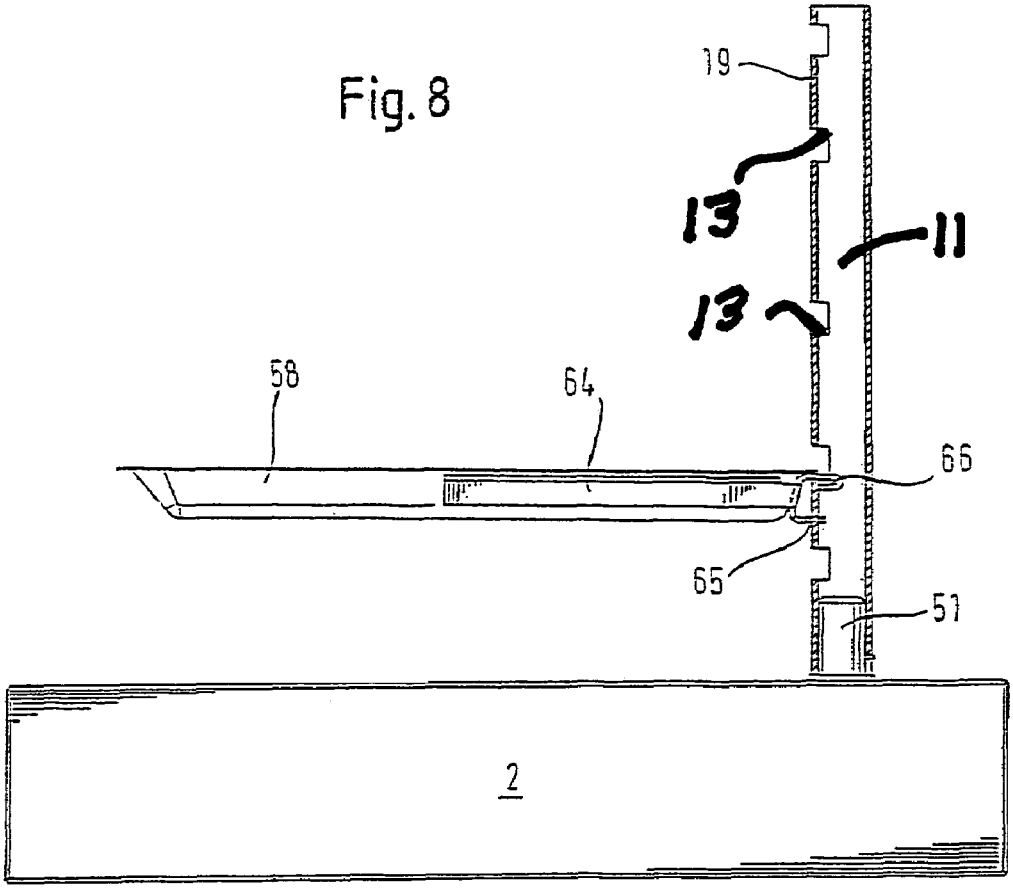
FIG. 8 shows a sectional view of the trap-door having a support column mounted on it into which a baking tray has been hooked.

As already mentioned above, and as shown in FIGS. 5, 7 and 8 the baking tray mounting arrangement 19, 51 is retained on the upper surface of the trap-door 2 and is contained within the cooking space 32, when the trap-door 2 is closed. The baking tray mounting arrangement, according to FIG. 8, includes the fixing piece 19 for hooking up baking trays and an anchoring 51 next to the trap-door 2. In the present embodiment the fixing piece 19 includes two hollow-cylindrical support columns 11. Each of the support columns 11 has cut-outs 13 on the same respective levels formed into it, into which the baking tray 58 is hooked as shown in FIG. 8. The support columns 11 are arranged in the rear area of the cooking space 32, i.e. between the hob 10 and the sealed zone 18 indicated as a broken line.

Now, with reference to FIGS. 6 and 7, the mounting of the support columns 11 in the anchoring 51 fastened in the trap-door 2 according to the invention will be discussed. Each anchoring 51, according to FIG. 6, consists of a profiled sheet 52 shaped as "U", of which one side is attached to an inside wall of the trap-door 2. A hollow-cylindrical bearing piece 55 is placed in between the arms 53, 63 of each U-profile sheet 52. Each longitudinal end 54 of the bearing piece 55 includes a portion 57 of reduce diameter. These portions 57 are retained in opposite openings of the arms of each U-profile sheet 52 as shown in FIG. 7. FIG. 7 also shows that a cylindrical base 50 is mounted inside each hollow-cylindrical bearing piece 55 which can be fixed in the bearing piece 55 by means of a locking screw 59.

The hollow profile 60 of each support column 11, according to FIG. 7, corresponds to the shape of the cylindrical base 50 in such a way that the support columns 11 can be placed so as to fit loosely onto each of the bases 50. The cylindrical wall 60 of each support column 11 also comprises a recess 61 which receives a positioning pin 53 formed on the base 50 when the support column 11 is accurately placed onto the base 50.

In order to seal the mounting holes 22 in the glass-ceramic plate 8 receiving the bases 50, each base 50 is formed with an annular flange 70 in its central area according to FIG. 7. The outer diameter of the annular flanges 70 is larger than the diameter of the mounting hole 22 so that the annular flange 70 of the base 50 covers the mounting hole 22. An O-ring seal 56 is arranged between the annular flange 70 and the glass-ceramic plate 8. When the bearing piece 55 is mounted in the base 50 the annular flange 70 can exert a certain pressure upon the glass-ceramic plate 8 via the O-ring seal 56, which rests on the profiled sheet 52 of the anchoring 51 serving as a buttress. Thus the anchoring 51 is securely sealed relative to the glass-ceramic plate 8.

Figure 9:
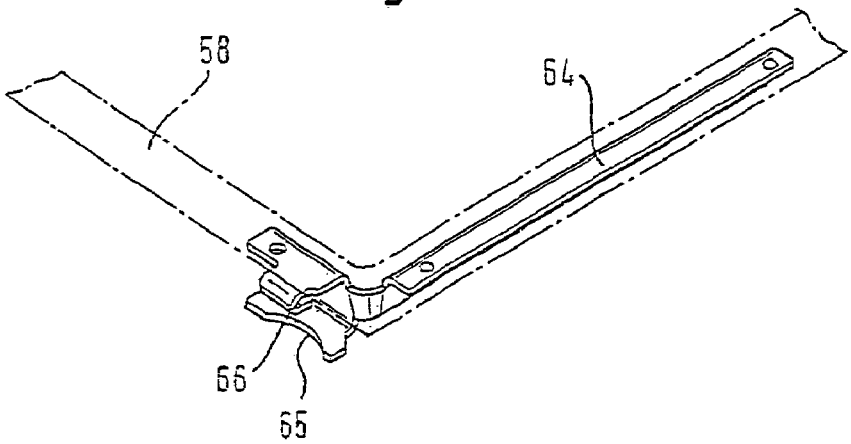
FIG. 9 shows a perspective view of a support piece attached to the baking tray.

As shown in FIG. 8, on each of its narrow sides the baking tray 58 is provided with a support piece 64, which is arranged below a horizontal rim of the baking tray 58 indicated by a chain-dotted line as shown in FIG. 9. According to FIG. 9 each support piece 64 has mounting projections 65, 66. When the baking tray 58 is hooked into the support columns 11, the upper mounting projections 66 of the support pieces 64 of the baking tray 58 shown in FIG. 9 are initially inserted into the window-like cut-outs 13 and come to rest against the inside wall of the support column 11, whilst the lower mounting projections 65 of the support pieces 64 of the baking tray 58 come to rest against an outside wall of the support column 11. Due to the torque exerted upon the mounting projections 65, 66 of the baking tray 58, the mounting projections 65, 66 remain resting securely against the inside and outside wall of the support columns 11.

With the help of a control provided on the control panel of the control unit 34 the high-level built-in oven 100 unit may be switched between a hotplate mode and a bottom heat mode, and these will now be discussed.

In the hotplate mode the hotplate heating elements 5, 6 can be individually operated via controls provided on the control panel of the control unit 34, whilst the sheet-type heating element 7 is inoperative. The hotplate mode can be used with the trap-door 2 lowered as shown in FIG. 1. But it can also be used in an energy-saving function when the cooking space 32 is closed due to the trap-door 2 having been raised.

In the bottom heat mode, according to the invention, not only the hotplate heating elements 5, 6 but also the sheet-type heating element 7 is controlled from the control unit 34. Moreover, when using the bottom heat mode, a top-heat heating element (not illustrated) provided at the top of the heated chamber 21 may be controlled from the control unit 34.

To ensure that the food browns as evenly as possible in bottom heat mode, it is critical that the hob 10 providing the bottom heat supplies an evenly distributed heat output across its surface, although the heating elements 5, 6, 7 have different nominal outputs. Therefore, according to the invention, the heating elements 5, 6, 7 are not switched by the control unit 34 to continuous operation, but the power supply to the heating elements 5, 6, 7 is clocked by switching elements (not illustrated) controlled by the control unit 34. With this arrangement the different nominal outputs of the heating elements 5, 6, 7 are individually reduced in such a way that the heating elements 5, 6 7 produce an evenly distributed heat output across the surface of the hob 10.

That sufficiently evenly distributed heat output may be adjusted by means of a further control of the control unit 34 by the user depending upon the heat output required.

The invention claimed is:

1. A high-level built-in oven unit, comprising:

a housing having a heated chamber including a cooking space and a floor opening;

said floor opening including a lowerable trap-door which is movable between a position closing said floor opening and a lower position which opens said floor opening;

said lowerable trap-door movable by a lifting device which includes lifting elements connected to said lowerable trap-door, said lifting device mounted in said housing with said lifting elements mounted outside said cooking space; and including a sealed zone formed between said lowerable trap-door in said closed position and said heated chamber, said zone surrounding said heated chamber and said lifting elements mounted outside said sealed zone.

2. The oven unit according to claim 1, including said sealed zone formed between an upper surface of said closed trap-door facing said cooking space and a face of a floor frame of said heated chamber.

3. The oven unit according to claim 2, including a seal forming said sealed zone mounted between said upper surface of said closed trap-door and said face of said floor frame of said heated chamber.

4. The oven unit according to claim 1, including said lifting elements formed as a pair of substantially rigid L-shaped support elements, each including a first arm connected to said lifting device and a second arm extending from said first arm to support said trap-door.

5. The oven unit according to claim 4, including said lifting device including a drive motor connected with at least one of said L-shaped support elements to move said lowerable trap-door which between a position closing said floor opening and a lower position which opens said floor opening.

6. The oven unit according to claim 1, including a baking tray mounting arrangement mounted on said trap-door facing said cooking space and which is positioned inside said cooking space when said trap-door is closed.

7. The oven unit according to claim 6, including a heat-resistant plate formed from a low thermal expansion coefficient material covering an upper surface of said trap-door.

8. The oven unit according to claim 7, including said heat-resistant plate formed from a glass-ceramic vitreous material.

9. The oven unit according to claim 7, including mounting holes in said heat-resistant for receiving and mounting said baking tray mounting arrangement on said trap-door.

10. A lifting device for a high-level built-in oven unit, including a housing having a heated chamber including a cooking space and a floor opening, said floor opening including a lowerable trap-door which is movable between a position closing said floor opening and a lower position which opens said floor opening, said lifting device comprising:

said lowerable trap-door movable by the lifting device which includes lifting elements connected to said lowerable trap-door, said lifting device mounted in said housing with said lifting elements mounted outside said cooking space; and including a sealed zone formed between said lowerable trap-door in said closed position and said heated chamber, said zone surrounding said heated chamber and said lifting elements mounted outside said sealed zone.

11. The lifting device according to claim 10, including said sealed zone formed between an upper surface of said closed trap-door facing said cooking space and a face of a floor frame of said heated chamber.

12. The lifting device according to claim 11, including a seal forming said sealed zone mounted between said upper surface of said closed trap-door and said face of said floor frame of said heated chamber.

13. The lifting device according to claim 10, including said lifting elements formed as a pair of substantially rigid L-shaped support elements, each including a first arm connected to said lifting device and a second arm extending from said first arm to support said trap-door.

14. The lifting device according to claim 13, including said lifting device including a drive motor connected with at least one of said L-shaped support elements to move said lowerable trap-door which between a position closing said floor opening and a lower position which opens said floor opening.

15. The lifting device according to claim 10, including a baking tray mounting arrangement mounted on said trap-door facing said cooking space and which is positioned inside said cooking space when said trap-door is closed.

16. The lifting device according to claim 15, including a heat-resistant plate formed from a low thermal expansion coefficient material covering an upper surface of said trap-door.

17. The lifting device according to claim 16, including said heat-resistant plate formed from a glass-ceramic vitreous material.

18. The lifting device according to claim 16, including mounting holes in said heat-resistant for receiving and mounting said baking tray mounting arrangement on said trap-door.

* * * * *